US008065758B1

(12) United States Patent
Mendez

(10) Patent No.: US 8,065,758 B1
(45) Date of Patent: Nov. 29, 2011

(54) LAVATORY VESSEL LIQUID DISPENSER

(76) Inventor: Edgar Gabriel Mendez, California City, CA (US)

( * ) Notice: Subject to any disclaimer, the term of this patent is extended or adjusted under 35 U.S.C. 154(b) by 1303 days.

(21) Appl. No.: 11/436,855

(22) Filed: May 17, 2006

(51) Int. Cl.
*E03C 1/244* (2006.01)

(52) U.S. Cl. ..... 4/654

(58) Field of Classification Search ..... 4/628; 222/192
See application file for complete search history.

(56) References Cited

U.S. PATENT DOCUMENTS

| | | | | |
|---|---|---|---|---|
| 923,447 | A * | 6/1909 | Schmidt | 4/628 X |
| 1,150,098 | A | 8/1915 | Bunting | |
| 1,722,456 | A | 7/1929 | Cranmore | |
| 1,958,992 | A | 9/1931 | Fraser | |
| 1,848,521 | A | 3/1932 | Fleck | |
| 2,689,659 | A | 2/1951 | Holycross | |
| 2,807,806 | A | 7/1955 | Watkins | |
| 3,018,489 | A | 4/1960 | Saflarski | |
| 3,078,471 | A | 2/1963 | Knibb | |
| 3,353,192 | A | 11/1967 | Christiansen | |
| 3,419,919 | A | 1/1969 | Stayner | |
| 3,731,326 | A | 5/1973 | Politz | |
| 4,625,896 | A | 12/1986 | Rocchelli | |
| 4,807,306 | A | 2/1989 | Hayman | |
| 4,815,634 | A | 3/1989 | Nowicki | |
| 5,110,271 | A | 5/1992 | Hofmann | |
| 5,114,048 | A | 5/1992 | Minke | |
| 5,226,196 | A | 7/1993 | Humlan | |
| 5,332,129 | A | 7/1994 | Brattoli | |
| 5,476,197 | A | 12/1995 | Lawrence | |
| 5,540,362 | A | 7/1996 | Azuma | |
| 5,625,908 | A | 5/1997 | Shaw | |
| 5,632,414 | A | 5/1997 | Merriweather | |
| 5,857,594 | A | 1/1999 | Ozturk | |
| 5,988,451 | A | 11/1999 | Hanna | |
| 6,023,795 | A | 2/2000 | Potter | |
| 6,131,771 | A | 10/2000 | Hanna | |
| 6,250,601 | B1 | 6/2001 | Kolar | |
| 6,290,109 | B1 | 9/2001 | Bougamont | |
| 6,467,651 | B1 | 10/2002 | Muderlak | |
| 6,502,721 | B2 | 1/2003 | Redman | |
| 6,651,851 | B2 | 11/2003 | Muderlak | |
| 6,718,568 | B1 | 4/2004 | Hensley | |
| 6,725,472 | B2 | 4/2004 | Gray | |
| 6,918,400 | B2 | 7/2005 | Bucher | |
| 6,959,842 | B2 | 11/2005 | Vert | |
| 7,647,653 | B1 * | 1/2010 | Catania | 4/628 |

* cited by examiner

*Primary Examiner* — Lori Baker
(74) *Attorney, Agent, or Firm* — Dennis W. Beech

(57) ABSTRACT

The present invention may be used for dispensing a liquid soap adjacent a faucet assembly having a vertical opening. A lift rod having a conduit therein may be slidably inserted in the vertical opening. A dispensing rod having a conduit may be attached at an upper end of the lift rod. A pump may be attached at a lower end of the lift rod for fluid communication with an outlet end of the pump. A reservoir tube may be attached to an inlet end of the pump and may be disposed at a second end in a liquid reservoir. The pump may have a flange and a lower portion. The lower portion may be slidably inserted in a support element to allow the flange to abut a top edge of the support element for operation of the plunger when a force may be applied to the lift rod.

12 Claims, 3 Drawing Sheets

LAVATORY VESSEL LIQUID DISPENSER

BACKGROUND OF THE INVENTION

This Invention relates to devices and apparatus used to dispense liquid such as liquid soap to a user of a lavatory basin or sink for use for example in washing hands. The new apparatus may have a tubular drain plug lift rod disposed in a faucet assembly with one end of the tubular rod connected to a fluid source such as a liquid soap source for up-down motion of the tubular rod to cause liquid soap to be dispensed from an outlet end at a lavatory.

Various liquid dispensing apparatus for use with lavatory vessels, such as sinks and basins may be known. These apparatus may use a reservoir or container located beneath a sink and mounted on a wall or placed on a horizontal surface. The reservoir may have a pump to force liquid soap through a tube that may have an outlet end disposed in a spigot of a faucet assembly of a sink. The pump may be powered by the up-down motion of an operating linkage for opening and closing a drain plug. Other liquid soap dispensers may be mounted in an aperture wherein the pump is operated separately from any drain plug operating linkage.

SUMMARY OF THE INVENTION

The present invention is directed to apparatus for dispensing a liquid, for example, liquid soap, adjacent to a spigot of a faucet assembly that may have a vertical opening therein. A lift rod having a conduit therein may be slidably inserted in the vertical opening. A dispensing rod having a conduit may be attached at an upper end of the lift rod. A pump may be attached at a lower end of the lift rod for fluid communication of the lower end with an outlet end of the pump. The lower end may be engaged with a plunger of the pump. A reservoir tube may be attached at a first end to an inlet end of the pump and may be disposed at a second end in a liquid reservoir. The pump may have a flange and a lower portion. The lower portion may be slidably inserted in a support element to allow the flange to abut a top edge of the support element for operation of the plunger when a force may be applied to the lift rod.

These and other features, aspects and advantages of the present invention will become better understood with reference to the following drawings, description and claims.

DETAILED DESCRIPTION

The following detailed description represents the best currently contemplated modes for carrying out the invention.

The description is not to be taken in a limiting sense, but is made merely for the purpose of illustrating the general principles of the invention.

Figure 1:
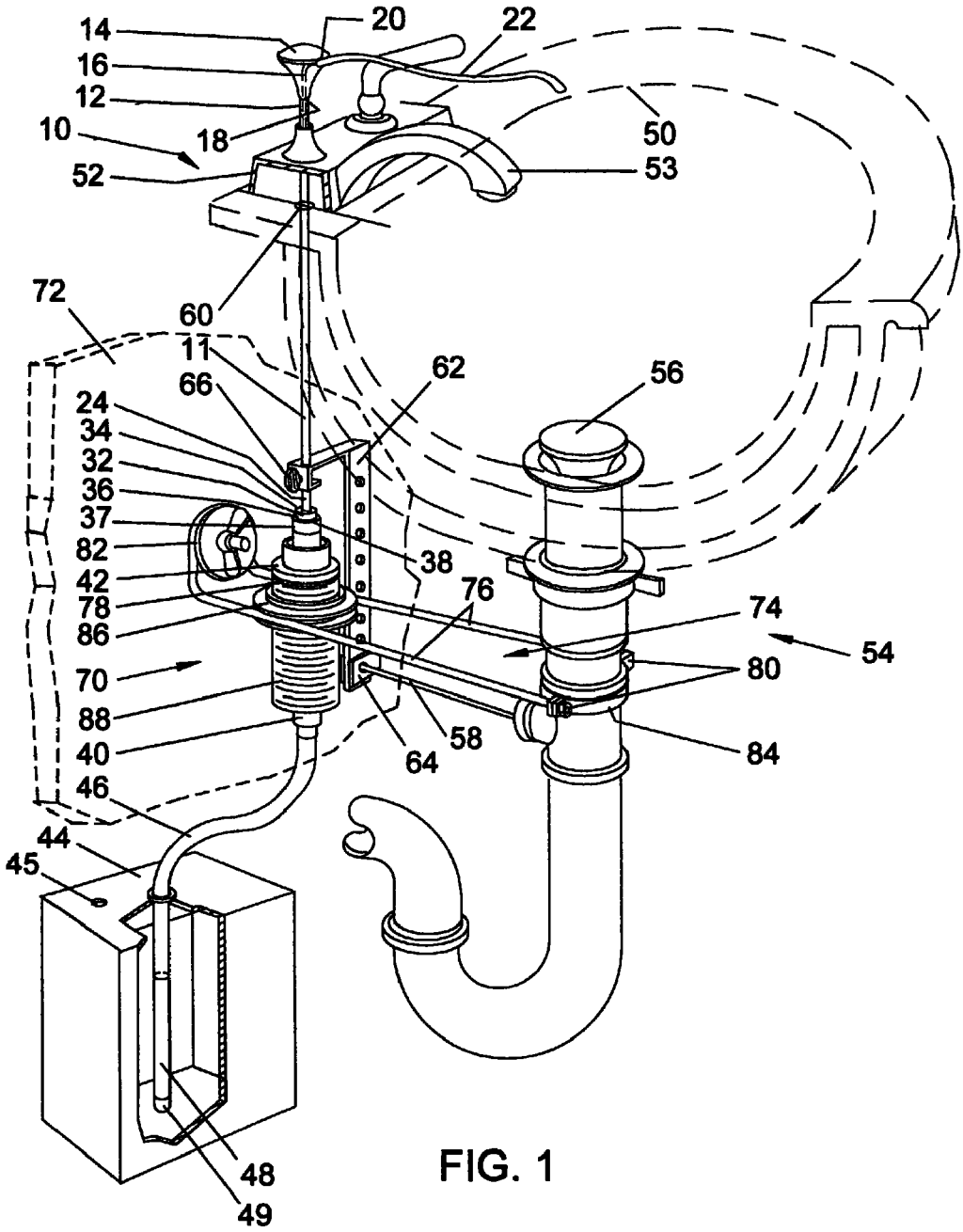
FIG. 1 illustrates a side elevation view of a lavatory vessel liquid dispenser according to an embodiment of the invention.
Figure 4:
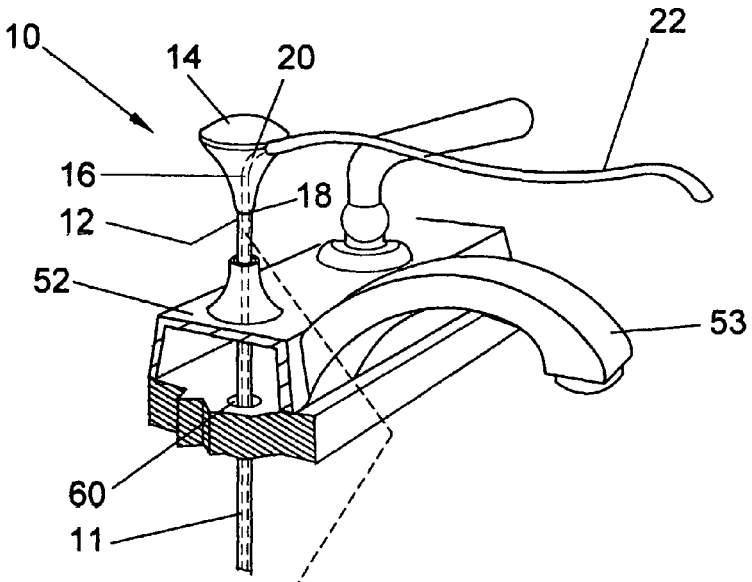
FIG. 4 illustrates a perspective view of a liquid dispenser upper structure in a faucet assembly according to an embodiment of the invention.

Referring to FIGS. 1 and 4, a conventional lavatory vessel, basin or sink 50 may have a faucet assembly 52 and a drain assembly 54 that may have a drain plug 56. The drain plug 56 may be operated between an opened and a closed position by a lever rod 58 or valve stem connected to a lift rod as currently understood in the art for this type of drain plug 56. The lift rod for a conventional sink 50 may be a solid rod slidably disposed in a vertical opening 60 in the faucet assembly 52 that may have a handle for a user to raise and lower the lift rod to open and close the drain.

A liquid dispenser 10 may have a lift rod 11 with a fluid conduit therein that may be slidably inserted in the vertical opening 60 and attached to the lever rod 58 by a connection member 62 and one or more spring clips 64. The connection member 62 may be fastened to the lift rod 11 by a set screw 66, U-bolt or the like. The tubular lift rod 11 may be attached at an upper end 12 to a handle 14 having a fluid conduit 16 therein. The upper end 12 may be threaded for threadable attachment in a first end 18 of the fluid conduit 16 that may be threaded. The fluid conduit 16 may transition through handle 14 from a generally vertical orientation at the first end 18 to a generally horizontal orientation at a second end 20. The second end 20 may be threaded for threadable attachment of a tubular dispensing rod 22 having a threaded end. The tubular dispensing rod 22 may have a shape and length for dispensing a fluid such as liquid soap adjacent the spigot 53 of the faucet assembly 52. The dispensing rod 22 may be attached at orientations other than horizontal. While threaded attachment to handle 14 has been described, other suitable attachment methods, for example, soldering, welding or the like, may be used to join the lift rod 11 and dispensing rod 22 to the handle 14 for a leak sealing joint.

The lift rod 11, handle 14 and dispensing rod 22 may be fabricated as an ornamental design in a common theme with a related faucet assembly 52 or may be a generic design. The lift rod 11, handle 14 and dispensing rod 22 may be fabricated as a single part of suitable material, for example, a composite or molded material, or as separate parts for assembly using material having sufficient strength to allow operation of the liquid dispenser 10 and other basin or sink elements.

Figure 5:
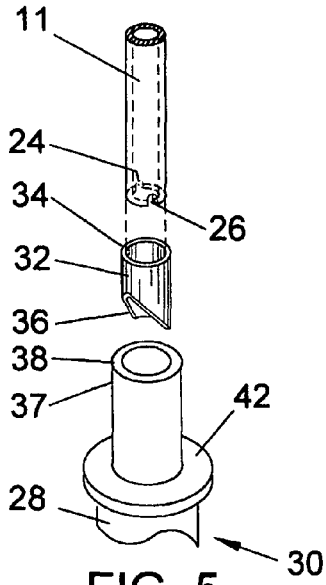
FIG. 5 illustrates an exploded side view of a pump adapter according to an embodiment of the invention.

Referring to FIGS. 1 and 5, a pump 30 may be attached to a lower end 24 of the tubular lift rod 11. A pump adapter 32 having a tubular form may have the lower end 24 inserted and attached at a first adapter end 34 and may have a second adapter end 36 attached to an outlet end 38 of the pump 30. The lower end 24 and first adapter end 34 and the second adapter end 36 and outlet end 38 may be attached by adhesive, threads, fasteners, press fit or the like.

The pump 30 may be constructed of light weight material, such as plastic, as may be understood in the art for lift pumps that may be used for liquid soap, cream, oil and the like dispensers. Other pump mechanisms may also be used. The outlet end 38 of the pump 30 may be an element of the pump connector 37 or plunger that may be pushed and pulled in and out of the pump 30 to pump a fluid. With the lift rod 11, pump adapter 32 and outlet end 38 connected, the lift rod 11 may be moved up and down to move the pump connector 37 up and down to pump fluid upwardly through the pump 30. A reservoir tube 46 may be attached at one end to an inlet end 40 of the pump. The reservoir tube 46 may have a second end 48 inserted in a reservoir 44 or container having liquid soap or other fluid contained therein. A one-way valve 49 may be attached to the second end 48. The reservoir tube may be attached at each end by adhesive, threads, fasteners, press fit or the like. The one way valve 49 may inhibit fluid from leaking back into the reservoir 44 that may occur due to fluid head pressure differential from the pump 30 and lift rod 11. There may be a vent aperture 45 in reservoir 44.

Figure 6:
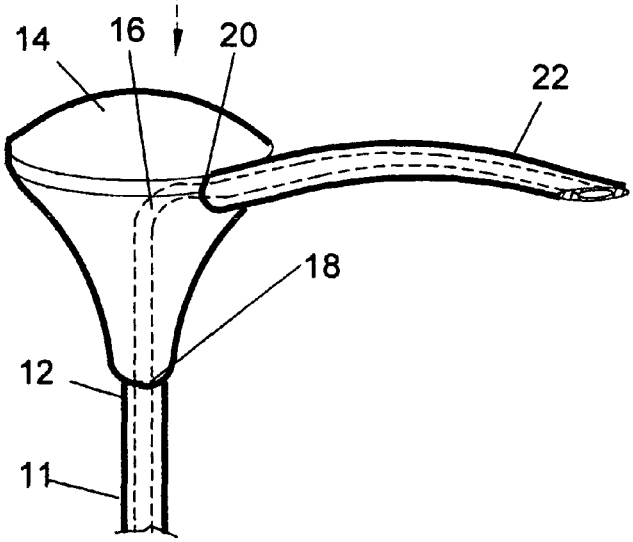
FIG. 6 illustrates an exploded view of a pump head pressure valve according to an embodiment of the invention.
Figure 6:
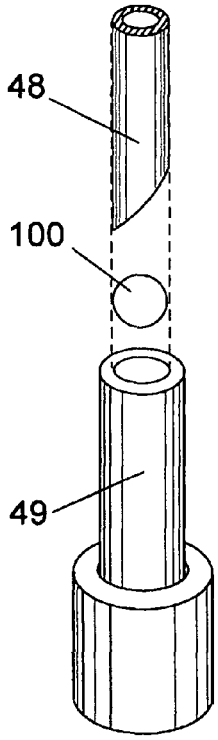

Referring to FIGS. 1, 5 and 6, the lift rod 11 lower end 24, the pump adapter 32 second end 36, and the reservoir tube 46 second end 48 may have fluid bypass structure to inhibit a ball 100 of a check valve or pump 30 from migrating upwardly thereby restricting fluid flow upwardly during operation of the liquid dispenser 10. Examples of a fluid bypass structure may be to form an angular opening in the pump adapter 32 second adapter end 36 or to form a slot 26 in lift rod 11 lower end 24.

In operation, the liquid dispenser 10 may be used to dispense liquid soap or other fluid by raising and lowering the handle 14 and thereby moving the lift rod 11 in an up-down manner. The pump 30 may have a flange 42 that may be used to restrict downward motion of the pump 30. The portion of the pump 30 below the flange 42 may be disposed in a support element 70 that may have a bracket 74 or other suitable support device that may have a pump adjustment device with a pump channel 89 that may allow vertical motion of the pump 30, but inhibit downward motion when the flange 42 abuts the top edge 78 of the pump channel 89. Further downward force on the handle 14 may then cause the plunger or pump connector 37 in the pump 30 to operate to force liquid soap upwardly out of the pump 30 to move upwardly in the lift rod 11. When the force on the handle 14 maybe removed, the return spring in the pump 30 may force the plunger upwardly to draw more liquid soap into the pump 30 chamber from a pump reservoir 44 for movement upwardly out of the pump 30 with the next downward motion of the plunger 37 caused by a force applied to the handle 14. Movement of the lift rod 11 may also move the drain plug 56 if the lever rod 58 is attached to the lift rod 11 by a connecting member 62. However, the liquid dispenser 10 may be structured and operated separate from the operation of the drain plug 56.

The support element 70 may have a bracket 74 that may be a bar, a rod or other suitable structure and material to position the pump 30 under a sink 50. The bracket 74 may be formed of two generally parallel rods 76 having a length to span the distance between a drain assembly 54 and a sink 50 support structure such as a wall 72. The rods 76 may be attached at a first end 80 to a clamp 84 suitable for attachment to the drain assembly 54. The rods 76 at a second end 82 may be attached to a wall 72 or a brace with a vertical structure attachment 83. A threaded nut 86, sleeve or the like device may be attached between the rods 76 with the nut 86 positioned below the location of the lift rod 11. A tubular insert 88 having external threads may be threadably disposed in the nut 86 with the top edge 78 positioned to limit downward motion of the pump 30. While a tubular and threaded insert may be described, other structures may be used, such as, a multi-walled polygon cross-section insert fixed by set screws, or other forms, that allow slidable insertion of a pump 30. The insert 88 may be rotated in the nut 86 to adjust the height of top edge 78 to adjust the allowed downward travel of a pump 30 that may have flange 42. When lift rod 11 may be raised, the pump 30 lower portion 28 may move upwardly in insert 88. When lift rod 11 may be lowered or pushed downwardly, the lower portion 28 may move downwardly until flange 42 engages top edge 78. If the lift rod 11 may be further forced downwardly, the pump 30 pump connector 37 or plunger may be pushed downwardly.

Figure 2:
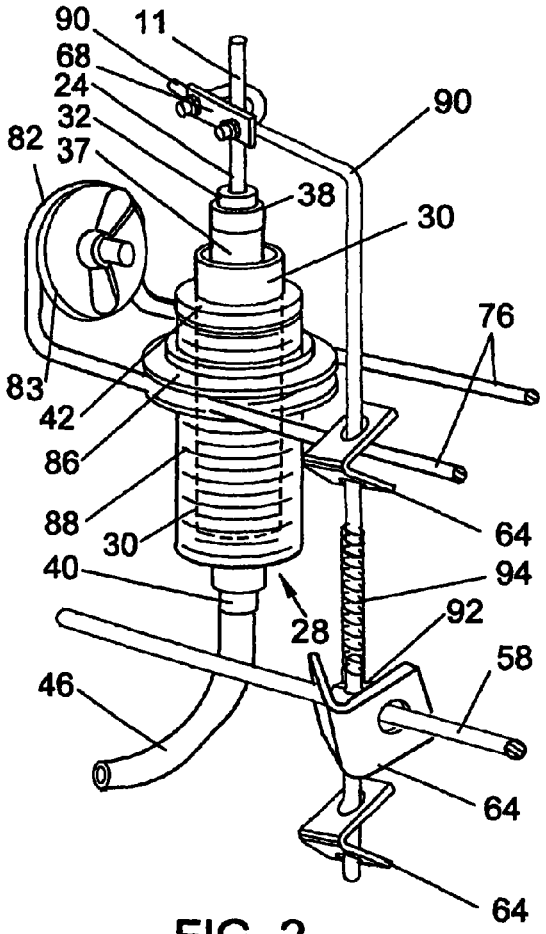
FIG. 2 illustrates a perspective view of a support element and lever rod according to an embodiment of the invention.
Figure 3:
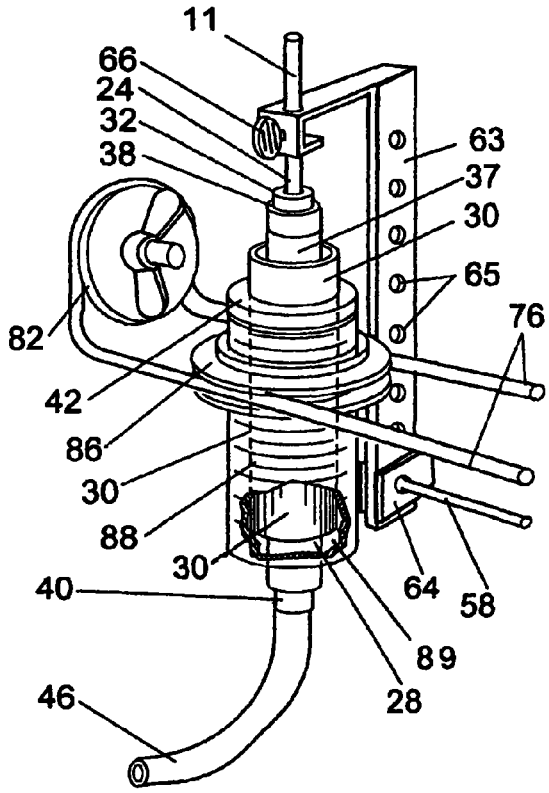
FIG. 3 illustrates a perspective view of a support element and lever bar according to an embodiment of the invention.

Referring to FIGS. 1 through 3, a lever rod 58 or valve stem for operating a drain plug 56 of a drain assembly 54 may be attached to lift rod 11 by a connection member 62. The connection member 62 may be a bar, rod, strap or other suitable structure. If a bar 63 or strap may be used, it may have multiple apertures 65 for insertion of a lever rod 58 that may be retained by a spring clip 64. The bar 63 may be attached to lift rod 11 by a set screw 66 or other fastener. When the lift rod 11 may be raised or lowered, the lever rod 58 at a distal end may be raised and lowered to operate the drain plug 56.

The connection member 62 may be a connection rod 90 that may be attached to lift rod 11 by a U-bolt clamp 68 or other fastener. An adapter 92 may be slidably positioned on the connection rod 90 for insertion of the lever rod 58 at a distal end. A spring 94 may be disposed on the connection rod 90 adjacent to and above the adapter 92. A first spring clip 64 may be positioned on the connection rod 90 above the spring 94 and a second spring clip 64 may be positioned on the connection rod 90 below the adapter 92. This may allow movement of the lift rod 11 to operate the pump 30 without causing movement of the drain plug 56. There may also be a third spring clip 64 to retain the lever rod 58 in the adapter 92.

Fluid wetted parts of the liquid dispenser 10 may be fabricated from non-corrosive material, such as plastic, stainless steel, brass and the like.

While a liquid dispenser 10 may have been disclosed as operating a pump 30, the lift rod 11 with fluid conduit may be attached to the lever rod 58 to operate a drain plug 56 and may be in fluid communication at lower end 24 with a pump and reservoir. The pump may be operable by an electric motor or other method that may only be activated rather than pumped by lift rod 11. The pump may move fluid from a reservoir to lower end 24 for the soap or fluid to move upwardly in lift rod 11 to be dispensed from tubular dispensing rod 22.

While the invention has been particularly shown and described with respect to the illustrated embodiments thereof, it will be understood by those skilled in the art that the foregoing and other changes in form and details may be made therein without departing from the spirit and scope of the invention.

I claim:

1. An apparatus for dispensing a liquid adjacent to a spigot of a faucet assembly having a vertical opening therein comprising:

a lift rod having a conduit therein slidably insertable in said vertical opening;

a dispensing rod having a conduit therein attached at an upper end of said lift rod;

a pump attached at a lower end of said lift rod for fluid communication of said lower end with an outlet end of said pump wherein said lower end attached to a plunger of said pump;

a reservoir tube attached at a first end to an inlet end of said pump and disposed at a second end in a liquid reservoir;

said pump having a flange and a lower portion of said pump slidably inserted in a support element disposed for said flange to abut a top edge of said support element for operation of said plunger when a force is applied to said lift rod;

a connection rod is attached to said lift rod by a fastener;

an adapter is slidably disposed on said connection rod and has a lever rod at a distal end inserted in said adapter;

a spring is disposed on said connection rod adjacent said adapter and retained by a first spring clip attached above said spring on said connection rod;

said adapter is retained by a second spring clip attached below said adapter on said connection rod; and said adapter is retained by a third spring clip attached on said lever rod.

2. The apparatus as in claim 1 wherein a handle is disposed and attached at said upper end and said dispensing rod disposed and attached to said handle wherein said handle having a fluid conduit in communication at a first end with said upper end and at a second end with said dispensing rod.

3. The apparatus as in claim 2 wherein said first end is soldered to said upper end of said lift rod and said second end is soldered to said dispensing rod.

4. The apparatus as in claim 2 wherein said dispensing rod is attached to said handle for generally horizontal orientation.

5. The apparatus as in claim 1 wherein said lower end of said lift rod is attached to said pump by a pump adapter comprising:

a first adapter end for insertion of said lower end and attachment of said lower end; and a second adapter end for insertion in said outlet end of said pump.

6. The apparatus as in claim 5 wherein said second adapter end has a fluid bypass structure.

7. The apparatus as in claim 1 wherein said lower end has a fluid bypass structure.

8. The apparatus as in claim 1 wherein said support element comprising:

a bracket that has two generally parallel rods attachable to a support structure under said faucet assembly; and a pump adjustment device with a pump channel in which said lower portion of said pump is inserted is disposed in said bracket.

9. The apparatus as in claim 8 wherein said bracket has a drain clamp at a first end and a vertical structure attachment at a second end.

10. The apparatus as in claim 8 wherein said pump adjustment device is a threaded nut disposed between said two generally parallel rods and a tubular insert threadably inserted in said threaded nut.

11. An apparatus for dispensing a liquid adjacent to a spigot of a faucet assembly having a vertical opening therein comprising;

a lift rod having a conduit therein slidably insertable in said vertical opening;

a dispensing rod having a conduit therein attached at an upper end of said lift rod;

a pump at an outlet end in fluid communication with a lower end of said lift rod and said pump at an inlet end in fluid communication with a reservoir; and said lift rod attached to a lever rod for operation of a drain plug in a drain assembly.

12. The apparatus as in claim 8 wherein said bracket has a drain clamp at a first end.

* * * * *